US008393108B1

(12) United States Patent
Wilson

(10) Patent No.: US 8,393,108 B1
(45) Date of Patent: Mar. 12, 2013

(54) UNIVERSAL QUICK-MOUNTING, NO BOLTS GUNSIGHT MOUNT

(76) Inventor: Brian Wilson, Boca Raton, FL (US)

( * ) Notice: Subject to any disclaimer, the term of this patent is extended or adjusted under 35 U.S.C. 154(b) by 13 days.

(21) Appl. No.: 13/429,768

(22) Filed: Mar. 26, 2012

(51) Int. Cl.
*F41G 1/387* (2006.01)

(52) U.S. Cl. ..... 42/111; 42/127

(58) Field of Classification Search ..... 42/111, 42/124, 127, 128, 90, 125, 148, 143
See application file for complete search history.

(56) References Cited

U.S. PATENT DOCUMENTS

| | | | | |
|---|---|---|---|---|
| 2,123,273 | A * | 7/1938 | Burton | 42/148 |
| 4,328,624 | A | 5/1982 | Ross | |
| 4,418,487 | A * | 12/1983 | Strahan | 42/125 |
| 4,894,941 | A * | 1/1990 | Karow, Jr. | 42/146 |
| 6,327,807 | B1 * | 12/2001 | Bergacker | 42/124 |
| 6,705,038 | B2 * | 3/2004 | Davenport et al. | 42/148 |
| 2011/0247258 | A1 | 10/2011 | Gentiline | |

OTHER PUBLICATIONS

Competitor file. All products and photos are prior to applicant's filing date.

* cited by examiner

*Primary Examiner* — Bret Hayes
*Assistant Examiner* — Reginald Tillman, Jr.
(74) *Attorney, Agent, or Firm* — Clifford Kraft

(57) ABSTRACT

A universal, quick-mount gunsight mount that does not require any bolts. The mount fits any pistol that has Picatinny Rail or that has any longitudinal groove on the lower muzzle. The mount includes a single piece that slips around the muzzle with two jaws that mate at the top when a sight is clamped on. A protrusion on each side of the mount mates into the slot formed by the Picatinny Rail on the gun, while a detent forces a member into a slot on the bottom of the muzzle. The mount becomes locked to the muzzle and will not move when the gun is fired. The bottom of the mount includes an optional rail that can be used for a laser or light. The mechanical sights supplied with the gun are not blocked and can be used when desired.

17 Claims, 5 Drawing Sheets

UNIVERSAL QUICK-MOUNTING, NO BOLTS GUNSIGHT MOUNT

BACKGROUND

1. Field of the Invention

The present invention relates to mounting accessories for guns and more particularly to a universal quick-mounting gunsight mount that does not require bolts.

2. Description of the Prior Art

Gunsight mounts for pistols are known in the art. All mounts made today are clamp assemblies that are bolted around the barrel of the gun. Most slip over the muzzle of the gun and are bolted at the bottom, the top or both. Some units are two-piece assemblies with a bolt on top and a bolt on the bottom, or slip-over assemblies with a single bolt on the bottom. Some units have two bolts on the top and two bolts on the bottom. In all these units, it is very difficult to achieve the correct tightness and equal tightness of the bolts without using a torque wrench. If the bolts are not correctly tightened, or equally tight in multi-bolt units, the mount can be offset either left or right causing non-repeatability in the sight mount accuracy on the same pistol, or the mount can slip when the gun is fired. Some units are made for only one make of pistol.

It would be extremely advantageous to have a universal gunsight mount that uses no bolts and mounts quickly. This unit should fit pistols from most or all major manufacturers.

SUMMARY OF THE INVENTION

The present invention relates to a universal, quick-mount gunsight mount that does not require any bolts. The mount fits any pistol that has Picatinny Rail mount and/or a light rail mount or laser mount on the lower muzzle. The mount of the invention is a single piece that slips around the muzzle. The device has two jaws with a mating top part that start in a slightly separated position to allow the unit to be slipped onto the muzzle. A protrusion on each side mates into the slots above the Picatinny Rail on the gun. A spring-loaded detent is slipped into the mount under the muzzle which, in a locked position, forces a member into a slot in the Picatinny Rail on the bottom of the rail. A scope sight is then clamped onto the top of the mount. The clamping of the sight causes the two jaws to pull together and tightly mate. This also causes the protrusions on the bottom to fit snugly into and along the slots formed by the Picatinny Rail. The mount thus becomes locked and will not move when the gun is fired. The bottom of the mount includes an optional rail that can be used for a laser or light. When used, these accessories do not have to be removed when the mount is removed. The mechanical sights supplied with the gun are not blocked by the mount of the present invention and can be used when desired.

DESCRIPTION OF THE FIGURES

Attention is now directed to several drawings that illustrate features of the present invention.

Several drawings and illustrations have been presented to aid in understanding the present invention. The scope of the present invention is not limited to what is shown in the figures.

DESCRIPTION OF THE INVENTION

Figure 1:
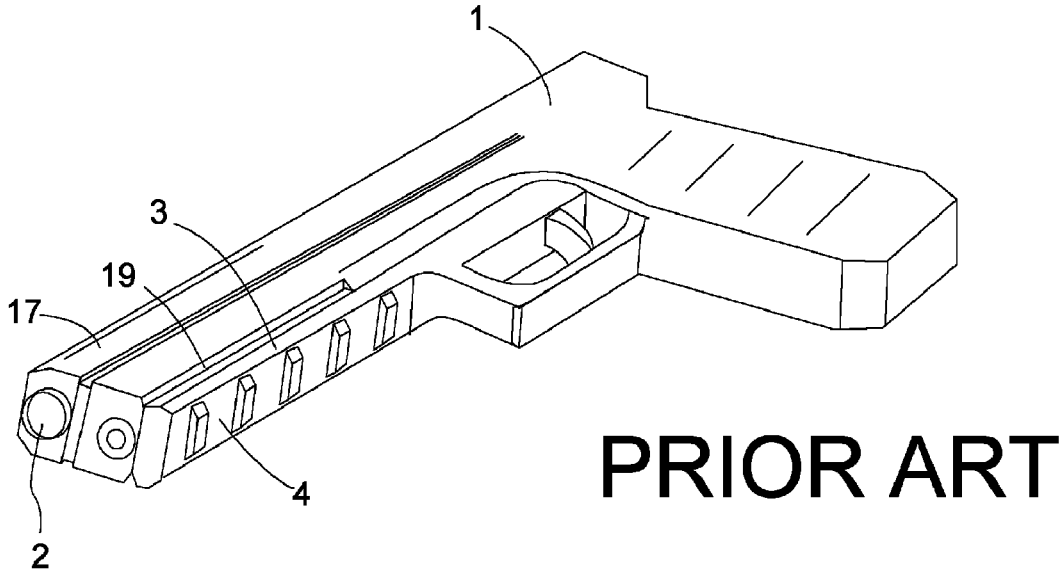
FIG. 1 shows a prior art pistol with no mount.

The present invention relates to a universal gunsight mount for pistols have Picatinny Rails or other types of longitudinal grooves along the muzzle. FIG. 1 shows a prior art pistol with on mount. The pistol 1 has a barrel 2 emerging from the muzzle 17. A Picatinny Rail 3 runs longitudinally along the bottom of the muzzle 17 forming a longitudinal groove 19. Also, there may be slots 4 for bolts on the bottom of the Picatinny Rail 3.

Figure 2:
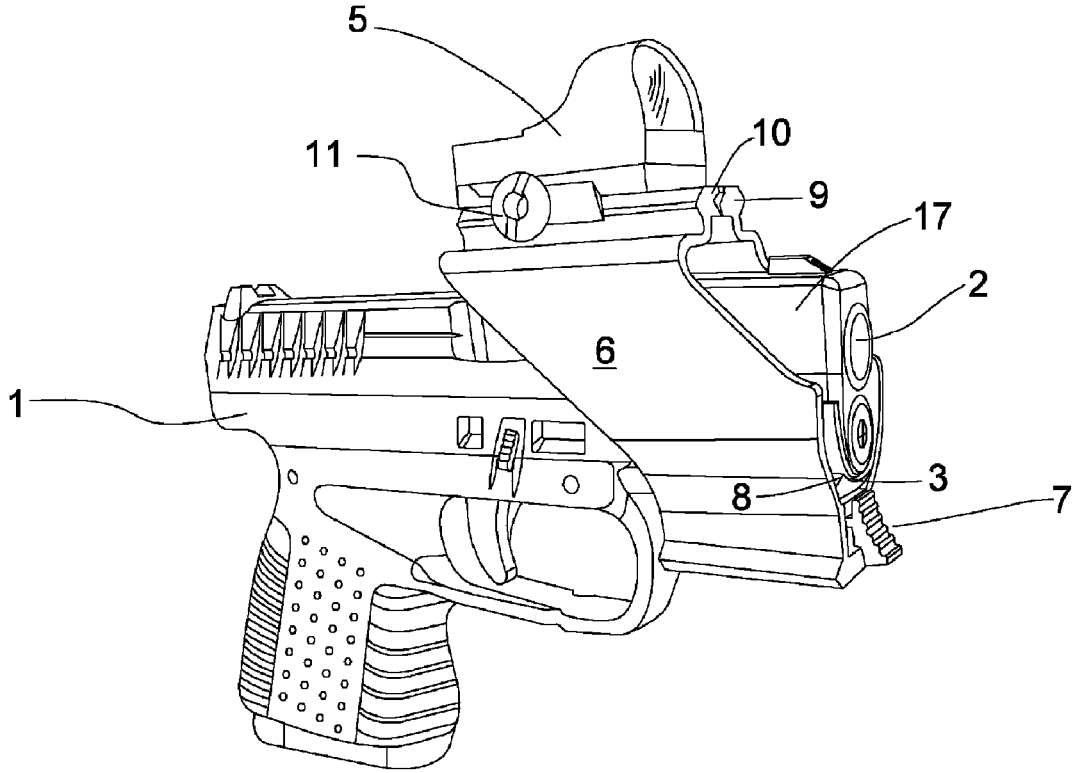
FIG. 2 shows a perspective view of an embodiment of the present invention fully mounted with a scope sight.

FIG. 2 shows a front and side perspective view of a pistol 1 with an embodiment of a mount with jaws 6 fully mounted with a scope sight 5. Just below the front bottom of the muzzle 17, a protrusion 8 that is part of the mount mates into the slot formed by the Picatinny Rail 3. A spring-loaded detent 7 has been inserted into the mount jaws 6 from the front just under the bottom of the muzzle 17. The detent 7, in a locked position, forces a solid member up into the bolt slot in the Picatinny Rail 3 securing the jaws 6 to the gun. The scope sight 5 has a clamping wheel 11 that, when screwed in, clamps the sight 5 to the mount 6. This clamping wheel 11 also forces the top of the mount 10, 9 together to tightly mate. One of the jaws 6 has a protruding ridge 9, while the other has a receiving and mating slot 10.

Figure 3:
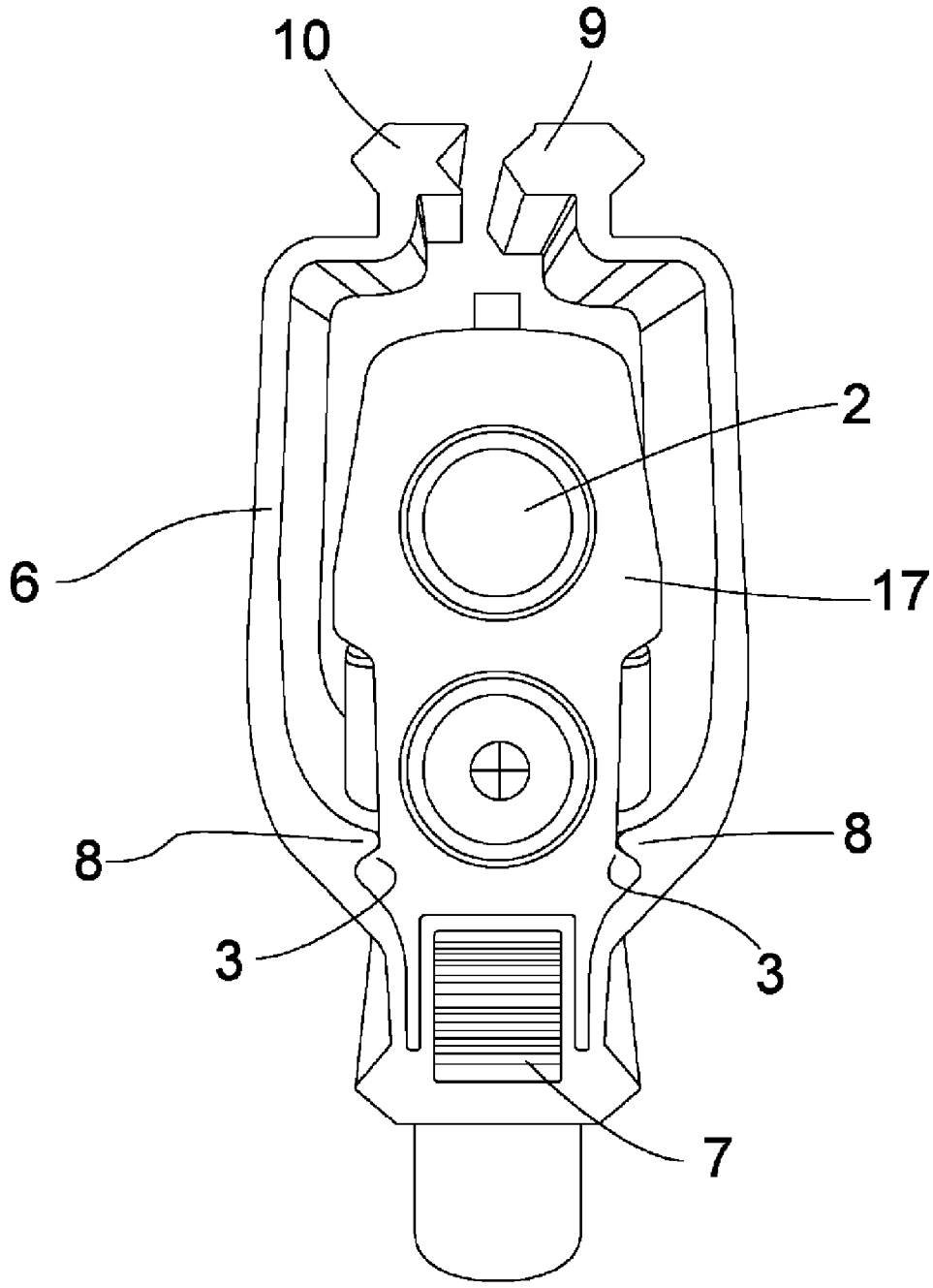
FIG. 3 shows a view looking into the muzzle of the mount of the present invention slipped over the muzzle, but not clamped.

FIG. 3 shows a pistol front-on looking down the barrel 2. The mount jaws 6 are shown in the open position before being clamped together with a sight. The spring-loaded detent 7 has been inserted into the mount 6 just below the bottom of the muzzle 17. The protrusions 8 on the insides of the bottom of the mount 6 slip into the Picatinny Rail slots 3. The top portions 8 and 9 of the mount are open allowing the mount to be slipped onto the muzzle 17.

Figure 4:
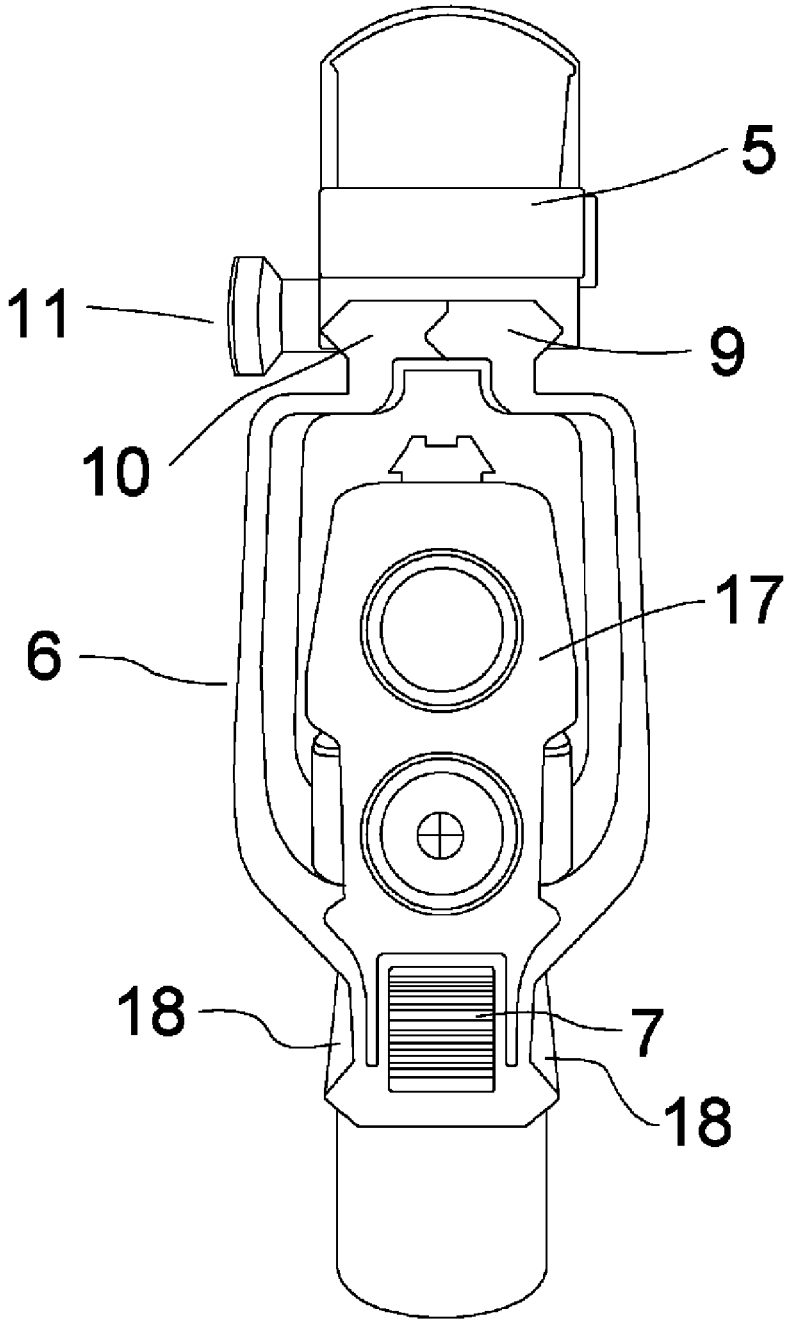
FIG. 4 shows a view similar to that of FIG. 3, but with the muzzle clamped by a sight.

FIG. 4 shows the same view as that of FIG. 3 except that now, the sight 5 has been clamped onto the mount jaws 6 by tightening the clamp wheel 11. The top portions 8 and 9 of the mount are pressed together and mate to form a non-slip connection around the muzzle 17. With the top of the mount 6 being held closed by the sight 5, six surfaces come together around the muzzle 17 keeping the mount rigid and straight. In this configuration, the mount will not slip or change position when the gun is fired. Two or more optional rails 18 on the bottom of the jaws of the mount can be used to mount a laser or a light. These accessories, when mounted, do not have to be removed when the mount is removed.

The mechanical front and back sights supplied with the gun can be seen through the mount and can be optionally used with the mount in place.

Figure 5:
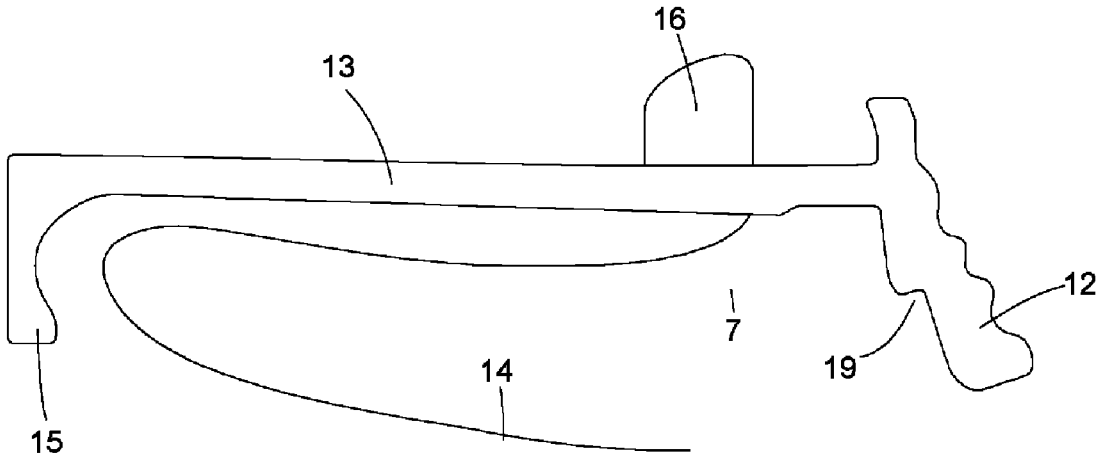
FIG. 5 shows a side view of an embodiment of a spring-loaded detent.

FIG. 5 shows a detail of the insertable spring-loaded detent 7. The device resembles a key with a front handle 12, a stem 13, and a descending tail 15. A spring 14 slides in with the detent 7. A step 19 gives the detent 7 two positions; an open position and a locked position. The detent strap-spring 14 forces the detent 7 to toward the upward position. The detent 7 moves up and down using the step 19 locking the mount to the pistol by forcing a vertical member 16 on the detent 7 into a slot 4 (FIG. 1) in the bottom of the gun's rail. Thus, no bolts or tools are needed for the installation or removal of the mount. The spring-loaded detent 7 replaces bolts of prior art devices.

Several descriptions and illustrations have been presented to aid in understanding the features of the present invention.

One with skill in the art will realize that numerous changes and additions may be made without departing from the spirit of the invention. Each of these changes and additions is within the scope of the present invention.

I claim:

1. A clamp-on universal gun sight mount for a pistol of the type with longitudinal muzzle grooves on each side of the muzzle comprising:

a pair of left and right mount jaws connected at a bottom end adapted to fit over a pistol muzzle, said pair of mount jaws having a longitudinal length and configured to be squeezed together by a mounted sight at a top end;

wherein, one of said jaws, at said top end, has a protruding ridge running end-to-end along said longitudinal length that mates into a corresponding groove on the other of said jaws when said pair of jaws is squeezed together by said mounted sight;

wherein, each of said jaws also has a protruding ridge running end-to-end along a bottom portion of said jaws adapted to mate into said longitudinal muzzle grooves;

a spring-loaded detent insertable into said mount under said muzzle, wherein said detent in a locked position, forces a vertical member into a slot on a bottom surface of said muzzle;

whereby, when said pair of jaws is squeezed together by said mounted sight, said spring-loaded detent and all of said protruding ridges cause said mount to tightly clamp the mount onto said pistol.

2. The clamp-on universal gun sight mount of claim 1 further comprising a pair of rails running longitudinally along the bottom end of each of said jaws.

3. The clamp-on universal gun sight mount of claim 2 wherein said rails are adapted to hold a laser or light.

4. The clamp-on universal gun sight mount of claim 3 wherein said light or laser does not need to be removed when said mount is removed from the pistol.

5. The clamp-on universal gun sight mount of claim 1 wherein said longitudinal muzzle grooves are part of a Picatinny Rail.

6. The clamp-on universal gun sight mount of claim 1 wherein said spring-loaded detent has two positions, one causing the mount to lock onto said pistol, and one allowing the mount to release said pistol.

7. The clamp-on universal gun sight mount of claim 1 wherein standard mechanical pistol sights are not blocked when said mount is installed.

8. A universal sight mount with no bolts for a pistol having a Picatinny Rail comprising:

a pair of surrounding metal jaws clamped together around a pistol muzzle by a removable sight;

said metal jaws having longitudinal protrusions on internal surfaces that mate with slots above said Picatinny Rail;

said metal jaws having an insertable detent that, in a locked position, forces a member into a slot on a lower surface of said Picatinny Rail.

9. The universal sight mount of claim 8 wherein said mount does not block standard mechanical pistol sights.

10. The universal sight mount of claim 8 further comprising a pair of longitudinal rails on a lower part of said metal jaws.

11. The universal sight mount of claim 10 wherein said longitudinal rails are adapted to hold a laser or light.

12. The universal sight mount of claim 11 wherein said laser or light does not need to be removed when said mount is removed from the pistol.

13. A method of mounting a removable sight on a pistol comprising:

providing a pair of surrounding metal jaws clamped together around a pistol muzzle by a removable sight, said metal jaws having longitudinal protrusions on internal surfaces that mate with slots above a Picatinny Rail on said pistol;

providing an insertable detent that, when inserted into said jaws and in a locked position, forces a member into a slot on a lower surface of said Picatinny Rail.

14. The method of claim 13 wherein said mount does not block standard mechanical pistol sights.

15. The method of claim 13 further comprising providing a pair of longitudinal rails on a lower part of said metal jaws.

16. The method of claim 15 further comprising adapting said longitudinal rails to hold a laser or light.

17. The method of claim 16 wherein said laser or light does not need to be removed when said mount is removed from the pistol.

* * * * *